US006205966B1

(12) United States Patent
Breitenberger

(10) Patent No.: US 6,205,966 B1
(45) Date of Patent: Mar. 27, 2001

(54) MULTICYLINDER INTERNAL COMBUSTION ENGINE WITH TWO INLET VALVES AND TWO OUTLET VALVES

(75) Inventor: Manfred Breitenberger, Graz (AT)

(73) Assignee: Deutz AG, Cologne (DE)

( * ) Notice: Subject to any disclaimer, the term of this patent is extended or adjusted under 35 U.S.C. 154(b) by 0 days.

(21) Appl. No.: 09/367,252

(22) PCT Filed: Apr. 8, 1998

(86) PCT No.: PCT/EP98/02034

§ 371 Date: Aug. 10, 1999

§ 102(e) Date: Aug. 10, 1999

(87) PCT Pub. No.: WO98/45579

PCT Pub. Date: Oct. 15, 1998

(30) Foreign Application Priority Data

Apr. 9, 1997 (AT) ..... 606/97

(51) Int. Cl.[7] ..... F01L 1/26

(52) U.S. Cl. ..... 123/90.23; 123/90.39; 123/90.4

(58) Field of Search ..... 123/90.39, 90.4, 123/90.41, 90.44, 90.22, 90.23, 193.5, 193.3

(56) References Cited

U.S. PATENT DOCUMENTS

| | | | | |
|---|---|---|---|---|
| 2,650,578 | * | 9/1953 | Daub | 123/90.39 |
| 3,428,032 | * | 2/1969 | Rudert | 123/90.4 |
| 4,732,119 | * | 3/1988 | Melde-Tuczai et al. | 123/90.4 |
| 4,741,301 | * | 5/1988 | Patterson | 123/90.22 |
| 4,791,893 | * | 12/1988 | Muranaka et al. | 123/90.4 |
| 4,819,591 | * | 4/1989 | Valentine | 123/90.44 |
| 5,038,732 | * | 8/1991 | Matayoshi et al. | 123/90.4 |
| 5,101,777 | | 4/1992 | Onishi et al. | 123/90.23 |
| 5,127,380 | * | 7/1992 | Morishita | 123/90.4 |
| 5,375,568 | * | 12/1994 | Manolis et al. | 123/90.22 |
| 5,638,783 | * | 6/1997 | Regueiro | 123/90.22 |
| 5,669,344 | * | 9/1997 | Regueiro | 123/90.22 |
| 5,673,660 | * | 10/1997 | Regueiro | 123/90.4 |

FOREIGN PATENT DOCUMENTS

| | | |
|---|---|---|
| 1242045 | 6/1967 | (DE) . |
| 2025304 | 5/1970 | (DE) . |
| 0194922 | 9/1986 | (EP) . |
| 2019808 | 7/1970 | (FR) . |
| 1279977 | 6/1972 | (GB) . |

* cited by examiner

*Primary Examiner*—Teresa Walberg
*Assistant Examiner*—Fadi H. Dahbour
(74) *Attorney, Agent, or Firm*—Charles L. Schwab; Hardaway/Mann IP Group; Nexsen Pruet Jacobs & Pollard, LLP

(57) ABSTRACT

The invention relates to a multicylinder internal combustion engine with two inlet valves and two outlet valves (12, 11), the outlet valves (11) being located on one side of an internal combustion engine and the inlet valves (12) being located on the other side. The outlet valves (11) and the inlet valves (12) are actuated by a camshaft via inlet rocker arms (4) and outlet rocker arms (5). In order to reduce the size of the cylinder heads (1) and the rocker housing (2), the inlet rocker arm (4) and the outlet rocker arm (5) are forked. Each forked rocker arm (4,5) actuates two similar valves (12,11) per cylinder (13). The axes (**4*a*, 5*a*) of the inlet rocker arms (4) or outlet rocker arms (5**) are staggered in relation to each other or preferably overlap.

12 Claims, 2 Drawing Sheets

MULTICYLINDER INTERNAL COMBUSTION ENGINE WITH TWO INLET VALVES AND TWO OUTLET VALVES

TECHNICAL FIELD

This invention relates to a multiple cylinder internal combustion engine with two inlet or intake valves and two outlet or exhaust valves, the intake valves and the exhaust valves being arranged on opposite longitudinal sides of the engine, and the intake valves and exhaust valves being operated by a camshaft via intake rocker arms and exhaust rocker arms, respectively.

BACKGROUND OF THE INVENTION

The internal combustion engine disclosed in German Patent No. 12 42 045 has intake rocker arms and exhaust rocker arms, which for each cylinder are combined into one forked rocker arm and one bridge rocker arm. The bridge rocker arm, because of the connecting webs, effects a considerable increase in the mass to be moved and a reduction in flexural stiffness.

A similar development is shown in European Patent EP 0 194 922 concerning a spark-ignition internal combustion engine with a central overhead camshaft, in which the valves are operated either by two bridge rocker arms or by one bridge rocker arm and two individual rocker arms.

OBJECTS AND SUMMARY OF THE INVENTION

It is an object of the invention to avoid the disadvantages of the previously designed engines with a compact size of the cylinder head and of the rocker arm housing.

The objects of this invention are achieved by using an intake rocker arm and an exhaust rocker arm which are made as forked rocker arms, each forked rocker arm operating two like valves per cylinder. The pivot axes of the intake rocker arms and of the exhaust rocker arms, respectively, are offset relative to one another, one above another, the rocker arms being rotatably supported in a rocker arm housing mounted on the cylinder head by individual bearing journals which are removable from the rocker arm housing from the cylinder head side. Less space is required when the axis of the exhaust rocker arm for each cylinder is arranged obliquely above the axis of the intake rocker arm, thus the size of the cylinder head and of the rocker arm housing is very compact. Particularly space-saving is an arrangement in which the axes of the intake rocker arms lie in the parting plane between rocker arm housing and cylinder head. The valve axes may all be parallel to one another or the valve axes may subtend at an acute angle. The exhaust rocker arms of all cylinders of a cylinder bank are supported on a continuous shaft, thus permitting the timing of the exhaust valves to be changed by rotating the shaft or an eccentric sleeve supporting.

This makes it possible to implement an engine brake in a simple fashion. In a preferred embodiment an eccentric sleeve or bearing shell supports the shaft in the region of the support of each exhaust rocker arm and is connected to a rotation mechanism on an end face of the internal combustion engine.

Preferably, the forked rocker arms, viewed in horizontal projection, have an asymmetric shape, so that the push rods for the operation of the rocker arms can be spaced relatively far from one another. The space freed between the push rods can be used for cylinder head bolts and the fuel supply line.

In an especially preferred embodiment of the invention, the axes of the intake rocker arms and exhaust rocker arms are arranged on the intake valve side of the engine longitudinal plane, and the intake ducts as well as the exhaust ducts issue from lateral flange surfaces on the exhaust valve side of the longitudinal plane of the engine. The intake plenum is arranged above the exhaust manifold, so that all breathing ducts can be placed on one engine longitudinal side. The space thereby freed on the opposite engine longitudinal side can be used for the placement of other units, for example the injection pump.

In an embodiment of the invention that is very simple to fabricate and saves space, the bearings for the exhaust rocker shaft are formed by holes in the rocker arm housing.

In further development of the invention, the stems of the intake valves may have a shorter length than the stems of the exhaust valves, the valve springs of the intake valves preferably being shorter than the valve springs of the exhaust valves. It is advantageous to have the stroke of the exhaust valves longer than the stroke of the intake valves. Intake and exhaust rocker arms can be made with unequal mechanical advantages.

BRIEF DESCRIPTION OF THE DRAWINGS

The invention is shown in detail in the drawings, in which.

DETAILED DESCRIPTION OF THE INVENTION

Figure 1:
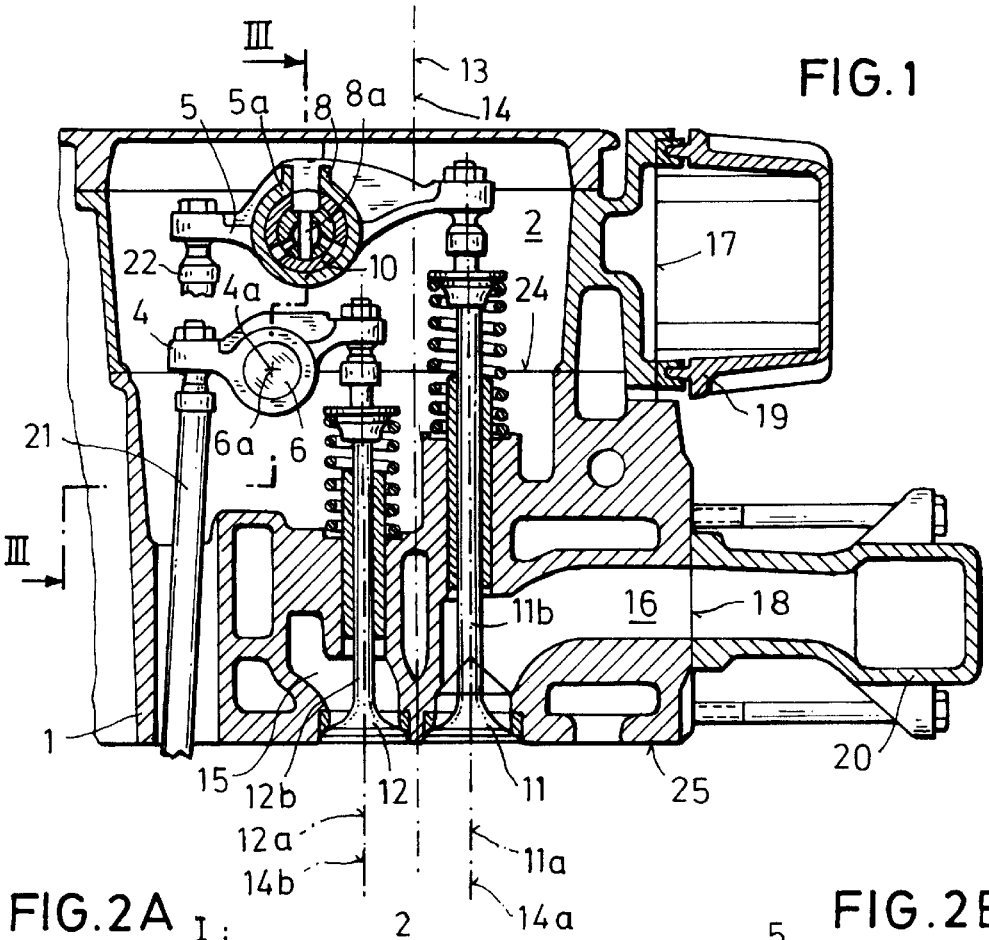
FIG. 1 is a cross section through a cylinder head and a rocker arm housing of the internal combustion engine along line I—I in FIG. 2.

Referring to FIG. 1, a rocker arm housing 2 is bolted to a cylinder head 1 in which there are, for each cylinder, an intake rocker arm 4 and an exhaust rocker arm 5, whose parallel axes 4*a* and 5*a* are arranged one obliquely above another. The intake rocker arms 4 are individually rotatably supported on bearing journals 6, which are bolted to the rocker arm housing 2 by bolts 7 extending upwardly from a cavity of the cylinder head 1. The axis 6*a* of the bearing journals 6 lies in the parting plane 24 between cylinder head 1 and rocker arm housing 2. The exhaust rocker arms 5 for all the cylinders of a cylinder bank are supported on an axis 8*a* by a single shaft 8 journaled in aligned openings in the rocker arm housing 2.

As shown in the drawings, the shaft 8 can be rotated by a rotation mechanism 9 on an end face of the engine. The support for the exhaust rocker arms 5 includes slightly eccentric sleeves or shells 10. The timing of the exhaust valves 11 is changed by rotating the eccentric shells 10 and thus an engine braking action can be achieved.

Space requirements within the cylinder head 1 and the rocker arm housing 2 are reduced by making the stems 12*b* of the intake valves 12 smaller in height than the stems 11*b* of the exhaust valves 11. The valve springs for intake valves 12 and exhaust valves 11 can also have unequal lengths. The axis 6*a* of the bearing journal 6 of the intake rocker arm 4 and the axis 8*a* of the shaft 8 of the exhaust rocker arm 5 are arranged on one side of an engine longitudinal plane 14 defined by the crankshaft axis and the cylinder axes 13. The intake ducts 15 and the exhaust ducts 16 extend from flange surfaces 17, 18 on the opposite side of the engine longitudinal plane 14, the intake flange surface 17 being formed on the rocker arm housing 2 and the exhaust flange surface 18 being formed on the cylinder head 1. The intake plenum 19 is thus disposed above the exhaust manifold 20.

Figure 3A:
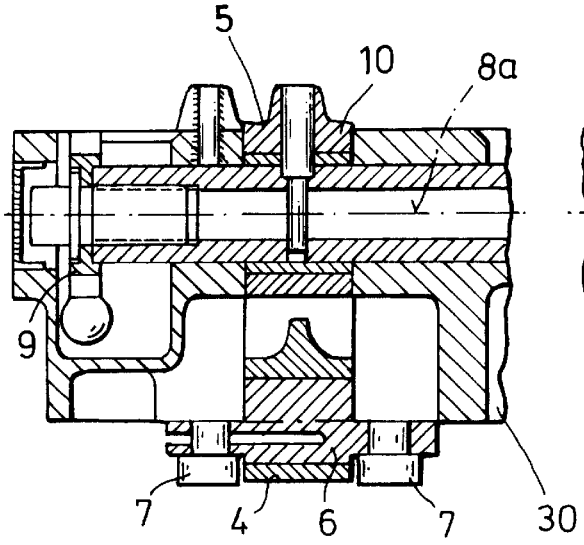
FIG. 3 is a section through the rocker arm housing, along line III—III in FIG. 2
Figure 3B:
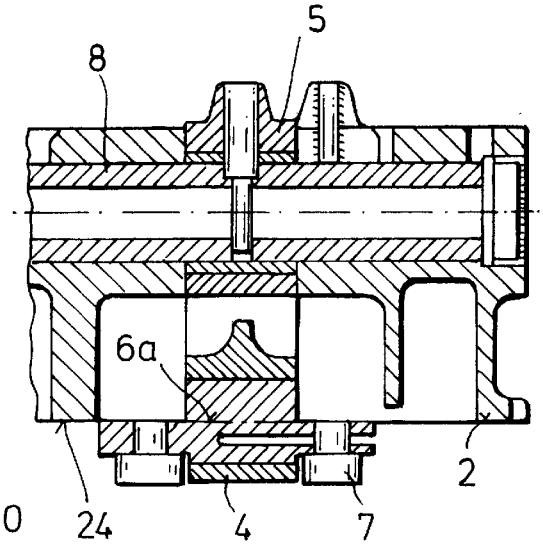

An intake duct may be formed in the cylinder head 1 between the operating mechanisms for the intake valves 12. For every two adjacent cylinders, the intake duct consists of a main duct 30 formed partly by the rocker arm housing 2 (FIG. 3) and four subducts, each of which leads to one intake valve 12 of the two cylinders, For each cylinder, one subduct is formed as a swirl duct and one subduct is formed as a charge duct.

The charge ducts issue from a common cross-sectional region of an intake plenum formed by the main duct 30. The intake ducts 12 of every two adjacent cylinders are arranged symmetrically relative to a plane normal to the crankshaft axis and passing between the two adjacent cylinders.

The intake plenum and the main duct 30 are located in the parting plane 24 between the rocker arm housing 2 and the cylinder head 1. This makes it possible to fabricate the rocker arm housing 2 as a die-casting.

The main duct 30 of the intake system passes between the supports for the bearing journals 6. As described above, it branches in a symmetrical fashion into a total of four subducts for the supplying of air or an air/gas mixture to two adjacent cylinders.

Figure 2A:
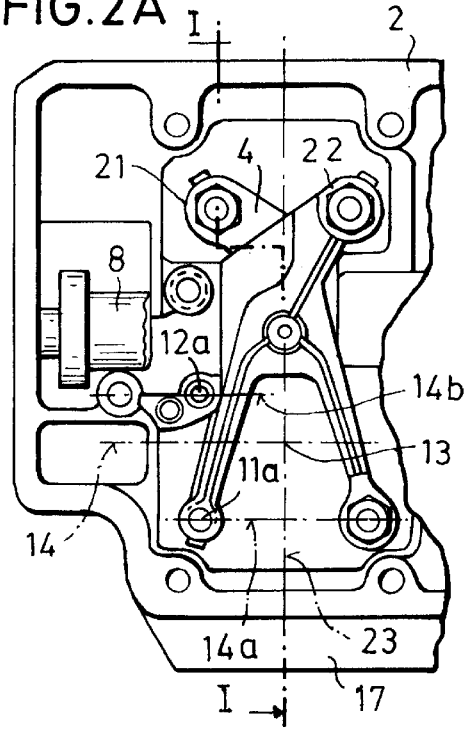
FIG. 2 is a top view of the rocker arm housing with its cover removed.
Figure 2B:
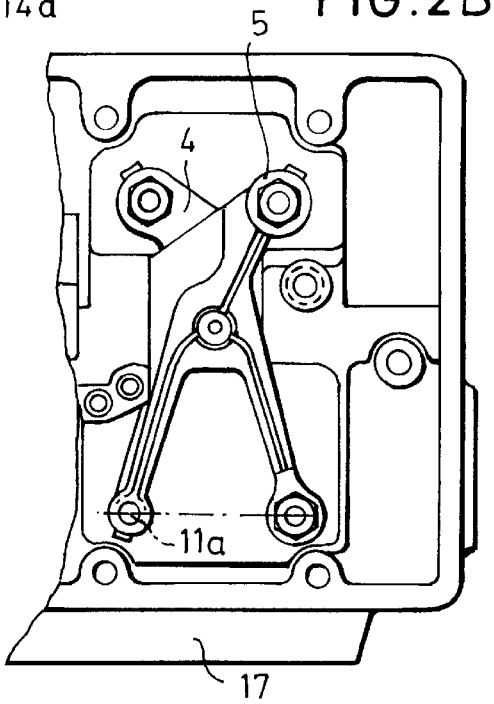
Figure 4:
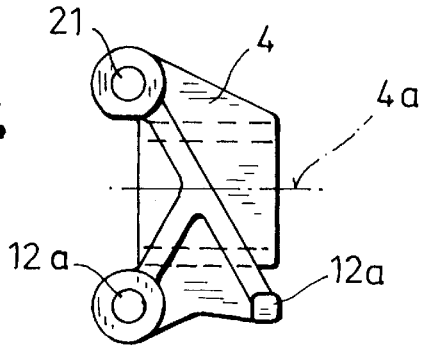
FIG. 4 is a top view of an intake rocker arm.

As shown in FIGS. 2 and 4, the intake rocker arms 4 and the exhaust rocker arms 5 have an asymmetrical shape in horizontal projection, so that a free space is formed between the push rods 21 and 22 for the intake rocker arm 4 and the exhaust rocker arm 5 in the region of the engine transverse plane 23, which free space can be used, for example, for the placement of a fuel supply line, not shown.

What is claimed is:

1. An internal combustion engine having a bank of at least two cylinders and further comprising:

a cylinder head (1) including two intake valves (12) for each cylinder, said intake valves (12) being disposed on one side of a longitudinal vertical plane (14) of said engine defined by the axes (13) of said cylinders and two exhaust valves (11) for each cylinder, said exhaust valves (11) being disposed on the other side of said longitudinal vertical plane (14), a rocker arm housing (2) mounted on top of said cylinder head (1) with the juncture of said rocker arm housing (2) and said cylinder head (1) defining a parting plane (24), a forked intake rocker arm (4) for each cylinder operatively engaging said intake valves (12) of the associated cylinder, separate bearing journals (6) supporting said intake rocker arms (4) on said rocker arm housing (1) for pivoting about an intake rocker arm pivot axis (4*a*), a forked exhaust rocker arm (5) for each cylinder operatively engaging said exhaust valves of the associated cylinder and a continuous exhaust rocker arm support shaft (8) supporting all of said exhaust rocker arms (5) on said rocker arm housing (2) for pivoting about an exhaust rocker arm pivot axis (82)

said exhaust rocker arm support shaft (8) being offset in a vertical direction from said bearing journals (6) supporting said intake rocker arms (4).

2. The internal combustion engine of claim 1 wherein said bearing journals (6) are removably mounted on the side of said rocker arm housing forming said juncture with said cylinder head (1).

3. The internal combustion engine of claim 1 wherein said exhaust rocker arm pivot axis (8*a*) is disposed a greater distance from said parting plane (24) than the distance said intake rocker arm pivot axis (4*a*) is disposed from said parting plane (24).

4. The internal combustion engine of claim 1 wherein said exhaust rocker arm pivot axis (82) is disposed a greater distance from said parting plane (24) than the distance said intake rocker arm pivot axis (4*a*) is disposed from said parting plane (24).

5. The internal combustion engine of claim 1 wherein said intake rocker arm axis (4*a*) lies in said parting plane (24).

6. The internal combustion engine of claim 1 wherein said exhaust rocker arm pivot axis (8*a*) is parallel to and disposed obliquely above said intake rocker arm pivot axis (4*a*).

7. The internal combustion engine of claim 1 wherein said intake and exhaust rocker arms (4,5) have and asymmetric shape when viewed from above.

8. The internal combustion engine of claim 1 wherein said intake and exhaust rocker arm pivot axes (4*a*, 5*a*) are disposed on said one side of said longitudinal vertical plane (14) and further comprising lateral flange surfaces (17, 18) on the lateral side of said rocker arm housing (2) and said cylinder head (1), respectively, disposed on said other side of said longitudinal vertical plane (14) and intake and exhaust ducts (15, 16) extending from said flange surfaces (17, 18), respectively, to said intake and exhaust valves (11, 12), respectively.

9. The internal combustion engine of claim 1 and further comprising an eccentric bearing shell (10) supporting said exhaust rocker arm shaft (8) on said rocker arm housing and a rotation mechanism (9) at a longitudinal end of said engine, said rotation mechanism being connected to and operable to rotate said eccentric bearing shell (10).

10. The internal combustion engine of claim 1 and further comprising aligned openings in said rocker arm housing (2) supporting said exhaust rocker arm support shaft (8).

11. The internal combustion engine of claim 1 wherein said intake and exhaust valves (12, 11) include valve stems (12*b*, 11*b*), respectively, and further comprising a valve spring on each of said valve stems (12*b*, 11*b*), said intake valve stems (12*b*) being shorter than said exhaust valve stems (11*b*) and said springs on said intake valve stems (12*b*) being shorter than said springs on said exhaust valve stems (11*b*).

12. The internal combustion engine of claim 1 wherein the stroke of said exhaust valves (11) are longer than the stroke of said intake valves (12).

* * * * *